United States Patent [19]

Buckett

[11] Patent Number: 4,825,761

[45] Date of Patent: May 2, 1989

[54] CONTROL SYSTEM FOR PRINTING MACHINES, ESPECIALLY NUMBERING MACHINES

[75] Inventor: David R. Buckett, Essex, England

[73] Assignee: The Governor and Company of the Bank of England, London, England

[21] Appl. No.: 284,813

[22] Filed: Dec. 14, 1988

Related U.S. Application Data

[63] Continuation of Ser. No. 95,172, Jul. 31, 1987, abandoned.

[30] Foreign Application Priority Data

Dec. 2, 1985 [GB] United Kingdom ..... 8529688

[51] Int. Cl.[4] ..... B41F 5/04

[52] U.S. Cl. ..... 101/77; 101/92; 101/228

[58] Field of Search ..... 101/76, 77, 86, 87, 101/88, 89, 91, 92, 228, 233, 234

[56] References Cited

U.S. PATENT DOCUMENTS

| | | | |
|---|---|---|---|
| 1,028,199 | 6/1912 | Dunlany | 101/76 X |
| 3,125,950 | 3/1964 | Ayers | 101/212 |
| 3,216,347 | 11/1965 | Bradley | 101/76 |
| 4,068,582 | 1/1978 | Poitras et al. | 101/76 |
| 4,207,814 | 6/1980 | Schenk | 101/76 |

FOREIGN PATENT DOCUMENTS

| | | | |
|---|---|---|---|
| 165734 | 12/1985 | European Pat. Off. . | |
| 1921381 | 11/1969 | Fed. Rep. of Germany . | |
| 2067651 | 8/1971 | France . | |
| 2284450 | 4/1976 | France . | |
| 2146291 | 4/1985 | United Kingdom | 101/228 |

OTHER PUBLICATIONS

"Numerieren: Elektronik Soll Sicherheit Erhöhen", in *Magazin Technik*, No. 3, 1979, pp. 190, 192.

*Primary Examiner*—Charles Pearson

*Attorney, Agent, or Firm*—Watson, Cole, Grindle & Watson

[57] ABSTRACT

A printing machine which has a printing cylinder (1) having automatically incremented numbering barrels (2) includes drive means (40–45) which normally maintain the printing cylinder in speed and phase synchronization with a train of documents on a web (11). The drive means is operable to decelerate the printing cylinder and then to cause the printing cylinder to regain its normal operating speed so that the web overtakes the printing by a selected distance before the next printing nip is formed.

1 Claim, 3 Drawing Sheets

CONTROL SYSTEM FOR PRINTING MACHINES, ESPECIALLY NUMBERING MACHINES

This application is a continuation of application Ser. No. 095,172, filed July 31, 1987, now abandoned.

BACKGROUND OF THE INVENTION

This invention relates to printing machines and particularly to a numbering machine of the kind used for printing repeatedly incremented numerical or alpha numerical codes on a train of documents.

One intended use of the invention is in a multistage machine, usually called web machine, employed for the printing of documents, e.g., bank notes. In such a machine a paper web, on which a train of documents is printed, is continuously transported at comparatively high speed through a multiplicity of printing and treatment stages, including a numbering station. Such a numbering station usually comprises a numbering cylinder which carries at least one set of numbering barrels, the barrels in each set being at spaced locations around its periphery. The printing cylinder co-operates with an impression roll to form a printing nip. Usually the numbering station is downstream from various printing stages which print, in one or more columns, a multiplicity of documents.

However the invention is also applicable where the documents are presented separately but in rapid succession.

It is usual for the numbering barrels on each printing cylinder to be incremented by a suitable modulus automatically between successive discrete angular positions so as to produce (though not necessarily from a single printing cylinder) a continuous series of numbers on the pre-printed documents when the machine is running normally. In such a machine as has been described, it would be desirable to cease overprinting by means of the numbering cylinder if a "spoil" document were detected. It will be understood that where overprinting is to be performed on documents which are printed as part of a continuous web, and the web contains random "spoil" documents (otherwise called misprints) it is desirable to inhibit the printing of, for example, a number in the series on the "spoil" document so that, after the documents have been individually separated from the web and the spoil documents have been removed, the remaining "good" documents bear respective numbers or alpha numeric codes in an unbroken sequence.

Numbering machines of the kind with which the present invention is concerned can be adjusted so that the incrementing of the numbering barrels can be inhibited for long runs but hitherto have not been adapted for the selective inhibition of incrementing such that randomly occurring "spoil" documents are not overprinted, i.e., they are omitted from the numbering sequence.

It is known from European Patent Application No. 85303863.6 (published Dec. 27, 1985 as EP-A2-0165734) to provide a spoil detector which can provide, in real time, scanning of documents on a continuously moving web and a control signal which denotes a "spoil" document. The present invention may be used in conjunction with such a detector.

SUMMARY OF THE INVENTION

The present invention is based on an improvement to a machine for printing on a train of sheets or documents and having a transport mechanism for driving the documents in succession through at least one printing station, the machine comprising a printing cylinder having spaced apart around its periphery one or more salient printing devices (such as numbering barrels) and drive means for rotating the printing cylinder at an operating speed corresponding to that of the sheets or documents whereby printing is effected on a document as the or each successive printing device forms a nip with an impression cylinder. An ordinary numbering machine of this kind will automatically increment the code provided by a respective numbering barrel in the interval between successive nips.

The basis of the present invention is the selective change of the printing cylinder from its normal operating speed and restoration of the printing cylinder back to its normal operating speed. In particular, the noted change is preferably a deceleration so that before the next printing nip is formed, the train of sheets or documents overtakes the printed cylinder by at least the distance between successive angular positions in which a nip can be formed.

By means of the present invention, when all the (preprinted) documents are to be overprinted, the printing cylinder will run at the operational speed corresponding to the speed of the documents. If a document passing through the printing nip is not to be overprinted, the printing cylinder decelerates to a slow speed or to rest so that it allows at least one document to pass through the region of the printing nip without being overprinted. On resumption of printing, the printing cylinder is accelerated to a speed corresponding to the speed of the documents and into phase lock with the documents in the correct printing position before the next nip is formed with the impression roll.

In the application of the invention to the control of a printing cylinder with a numbering barrel or barrels, the invention facilitates the maintenance of a complete series of codes on the documents which are actually overprinted, since the deceleration and acceleration of the printing cylinder can occur within the interval between successive nip-forming positions.

DESCRIPTION OF THE PREFERRED EMBODIMENT

Figure 1:
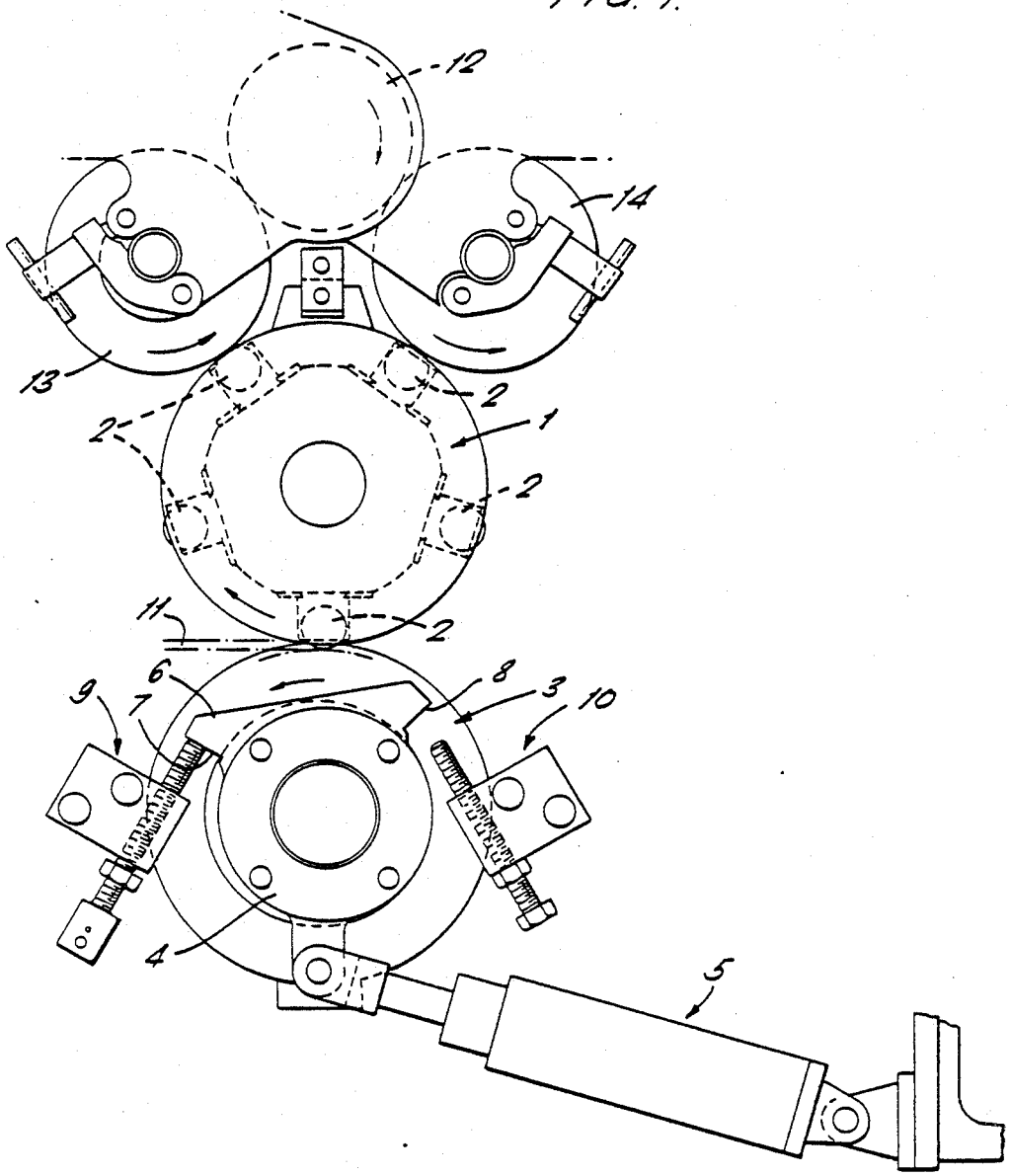
FIG. 1 illustrates a known form of numbering machine.

The printing station shown in the drawing includes a printing cylinder 1 of the kind having at least one numbering barrel and preferably a plurality of (in this example five) numbering barrels 2 spaced apart around its periphery. The printing cylinder is adjacent an impression roll 3 of which the height relative to the printing cylinder is adjustable by means of an eccentric 4 operable by a piston and cylinder assembly 5. The eccentric carries an abutment member 6 with end faces 7 and 8 engageable with adjustable end stops 9 and 10.

Each numbering barrel 2 can form a nip with the impression roll. A web 11, on which documents such as bank notes are printed at discrete intervals, is transported at a continuous, comparatively high speed (typically corresponding to an operating speed of 240 rpm for the printing cylinder).

Above the printing cylinder is an ink roll 12 engaging, in this embodiment, two forme rolls 13 and 14 positioned for successive engagement by the printing barrels 2. The forme rolls are each movable towards and away from the printing cylinder.

Drive for the impression roll and the rolls 12 to 14 may be provided by a suitable motor (not shown).

The numbering machine as so far described is of a well-known type which will be familiar to those skilled in the art. The machine may form part of a finishing machine by means of which bank notes or other documents which are pre-printed on the web 11 are overprinted, cut to size and sorted into bundles. Although the construction of a numbering machine is well-known, and the particular construction is not part of the invention, there follows for the sake of completeness a brief description of the operation of a numbering box or barrel with reference to FIGS. 2 and 3.

Figure 2:
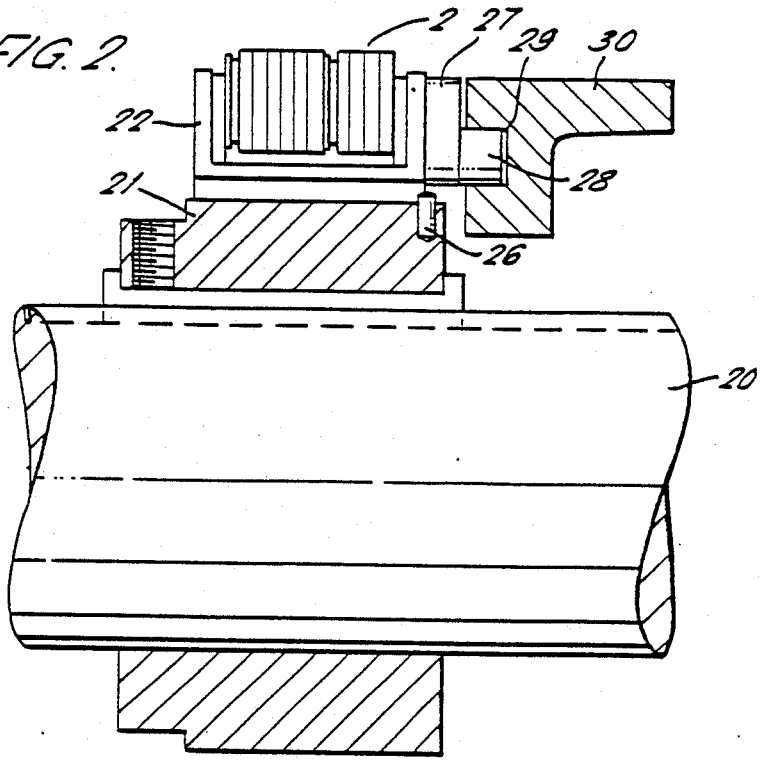
FIGS. 2 and 3 illustrate a detail of the numbering machine.
Figure 3:
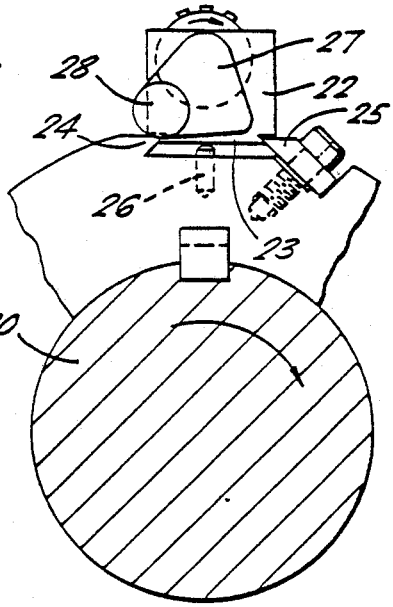

FIGS. 2 and 3 illustrates a shaft 20 on which are mounted numbering barrels 2 of which only one is shown in FIG. 2. The shaft 20 carries a mounting ring 21 having peripherally spaced grooves into each of which the frame 22 of a numbering barrel is secured, the foot 23 (FIG. 3) of the frame engaging a lip 24 at one side and a wedge 25, secured by a bolt to the ring 21, at the other. The radial position of the frame may be determined by a locating stop pin 26 disposed in a bore in the ring 21.

The frame 22 carries a respective numbering barrel 2 which is incremented by a pawl (not shown) actuated by a cam follower, comprising a crank 27 and a roller 28. The roller 28 engages a groove 29 in a cam track 30 disposed adjacent the path of the numbering barrel; the crank 27 is rotated through a suitable angle (such as 45°) to operate the pawl.

It is known practice to move the cam track to prevent normal operation of the roller but it is not practicable to inhibit the action of the numbering barrel in this way except for long periods.

Although the foregoing description is based on a machine in which overprinting is to be performed on a continuous web, the same general considerations apply to overprinting on each of a succession of sheets fed through the numbering machine.

Figure 4:
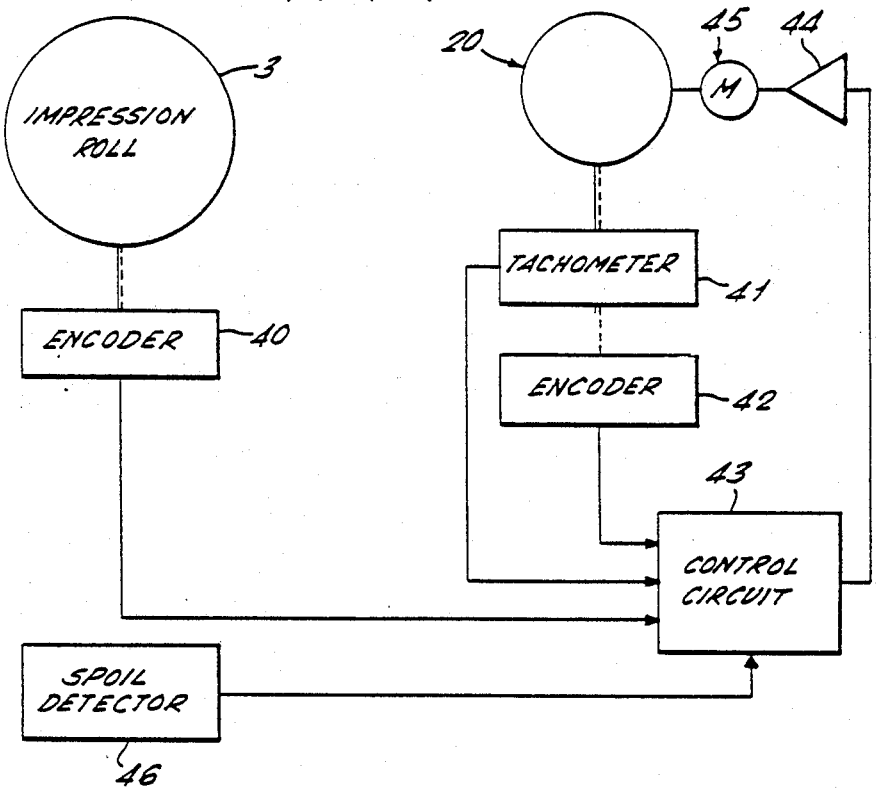
FIG. 4 illustrates schematically a control system for use with the numbering machine.

FIG. 4 illustrates in schematic form the main features of one embodiment of a control system for the numbering machine. The impression roll 3, which is driven at a peripheral speed corresponding to that of the web 11, has an encoder 40 which provides (in a manner known in itself) a set of parallel digital signals denoting the instantaneous position and speed of the impression roll and thereby the position and speed of the web. The encoder could be located elsewhere and could be driven directly by the web.

The numbering shaft 20 drives a tachometer 41 and a shaft encoder 42. A control circuit 43 (shown in more detail in FIG. 5) compares the signals from the encoders and controls a servo amplifier 44 in accordance with any phase error between the impression roll and the numbering shaft, so that the motor 45, which is driven by the servo amplifier, drives the numbering shaft in phase synchronism with the impression roll (and thereby with the web). In normal operation, that is to say in the absence of any detection of spoiled documents, the numbering cylinder overprints each successive document on the web. Typically the printing of the numbering cylinder will be to an accuracy better than 0.2 mm.

At some suitable position upstream of the numbering machine a spoil detector 46, which may be of the kind previously mentioned, scans the documents to detect any spoil, according to any suitable criteria. The spoil detector provides to the control circuit 43 a signal which initiates a command sequence by means of which the numbering shaft is, after a suitable delay which may be necessary to allow the spoiled document to reach the numbering machine, decelerated to allow the spoiled document to pass by the respective numbering barrel. The servo mechanism preferably decelerates the printing cylinder 1 so that it comes to rest in a parked position between two adjacent phase positions in which a nip is formed with the impression roll. For a printing cylinder with five equally spaced numbering barrels, such nip-forming positions occur at 72° intervals; the parked position is at some convenient point within such an interval. If only one document, or row of documents, is not to be overprinted, the printing cylinder may be immediately restarted. When overprinting is to recommence, the timing and acceleration are such that the printing cylinder is accelerated to synchronous speed before the next printing barrel forms a printing nip with the impression cylinder.

The restart of the printing cylinder may of course be inhibited for such time as may be desired; but is always retimed such that synchronism of the printing cylinder is achieved by the time the next nip-forming position is reached. In practice, prior to deceleration there may be about 7 to 8° synchronous movement after a nip-forming position after which deceleration commences and a similar amount of movement before the respective nip-forming position immediately after acceleration is completed. Typically the positional accuracy for the first printing after acceleration is better than 0.4mm, subsequent printings having the accuracy aforementioned.

Figure 5:
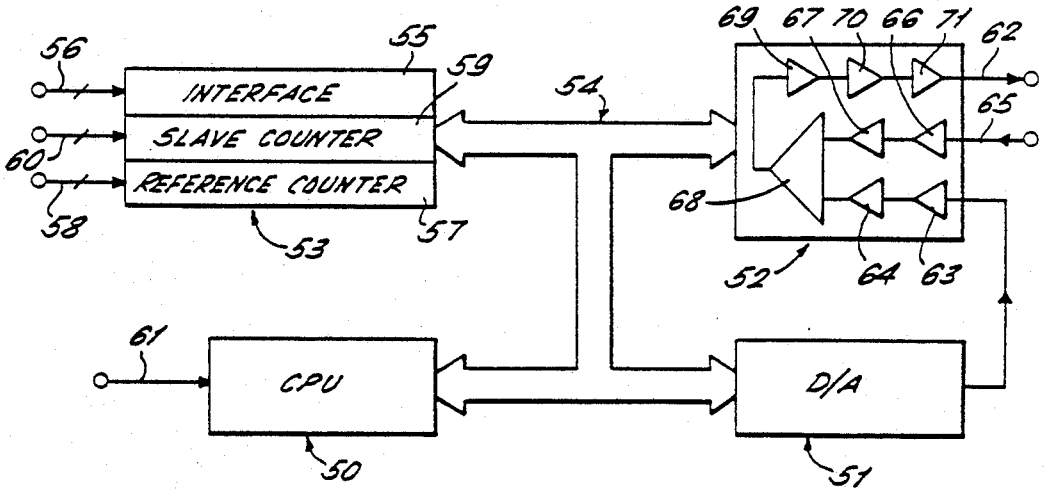
FIG. 5 illustrates part of the control system in greater detail.

FIG. 5 illustrates in simplified manner the operation of the servo control circuit 43. This is organized on the ordinary lines of a digitally controlled position servo which provides for traversal at a controlled rate and for stopping a controlled member on command. Such techniques are well-known in for example the art of digital recording on tape or disc.

The servo circuit comprises four main sections, namely a central processing section 50, a digital to analogue converter 51, a servo section 52 and a counter section 53. The central processing section controls the flow of data and/or clock signals along a data bus 54. The counter section includes an interface 55 which receives spoil signals and clock signals on lines 56, a reference counter 57 receiving the output of the impression roll encoder 40 on lines 58 and a slave counter 59 receiving the output of the numbering shaft encoder 42 on lines 60. The central processing section 50, which receives basic serial commands (such as start and stop commands) on line 61, will during normal operation effect sampling and comparison of the contents of the counters 57 and 59 to compute a digital error signal which is directed to the digital to analogue converter 51. The error is converted therein to an analogue signal which is processed by the servo 52 to provide a command signal on line 62 for the servo amplifier 44 (FIG. 4).

On detection of a spoil signal the central processing section interrupts the normal servo action and provides a command signal such as to decelerate the numbering shaft, preferably to zero velocity. This may be achieved by providing to the servo circuit by way of the converter 51 either a signal denoting zero velocity or a succession of signals defining a braking profile. In either case the resultant output of the converter 51 may be compared with the velocity feedback signal from the tachometer to bring the numbering shaft to rest under servo control.

The central processing section will ascertain that the numbering shaft is to be restarted by strobing the interface section to detect the absence of a spoil signal and will permit the normal servo action, under the control of counters 57 and 59 to recommence. The gain of the servo circuit should be sufficient to cause the acceleration of the numbering shaft to normal speed before the next printing nip is formed, but in practice this requirement is easily fulfilled.

The servo circuit comprises an amplifying stage 63 followed by a shaping stage 64 for the signal from the digital to analogue converter 51. This signal is combined when necessary with a velocity feedback signal obtained on line 65 from the tachometer and developed by an input stage 66 followed by an amplifying stage 67. The output of the summing stage 68 is fed to a shaper 69, an amplifying stage 70 and an output stage 71 to provide on line 62 the command signal to the servo amplifier 44. Switching of the gains of the servo circuit for the different operational modes is effected by control signals from the processing section 50.

The invention may be used for providing any selected change in the positional relationship between the printing cylinder and the train of sheets or documents; it is possible to provide an increase in the speed of the printing cylinder and subsequently a decrease to the normal operating speed.

I claim:

1. A machine for printing successive numbers on a series of printed documents on a web and which is capable of not printing a number on a spoiled document in said series of documents, said machine comprising a printing station which includes an impression cylinder and a printing cylinder, said printing cylinder including a plurality of salient numbering barrels respectively positioned around a periphery thereof, said numbering barrels forming nips with said impression cylinder as said printing cylinder and said impression cylinder rotate at a normal operating speed to thereby print successive numbers on successive documents of said series of documents as said web passes therebetween, drive means for rotating the printing cylinder, detector means for scanning the documents in said series of documents before passing between said impression cylinder and said printing cylinder and for detecting spoiled documents, and control means connected to said detector means and to said drive means so as to cause said drive means to decelerate said printing cylinder from a normal operating speed in response to a detected spoiled document and thereby allow the detected spoiled document to pass between said impression cylinder and said printing cylinder without being contacted by a numbering barrel, and for causing said drive motor to accelerate said printing cylinder back to said normal operating speed so that before a subsequent nip is formed, the web and series of documents will overtake the printing cylinder by at least a distance between successive angular positions in which said printing nip can be formed.

* * * * *